US007474736B2

(12) United States Patent
Munro et al.

(10) Patent No.: US 7,474,736 B2
(45) Date of Patent: Jan. 6, 2009

(54) DEVICES AND METHODS FOR PROVIDING SPATIALLY VARIABLE X-RAY BEAM INTENSITY

(75) Inventors: Peter N. Munro, Mountain View, CA (US); Kenneth W. Brooks, Alpharetta, GA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/957,064

(22) Filed: Oct. 1, 2004

(65) Prior Publication Data

US 2006/0072705 A1 Apr. 6, 2006

(51) Int. Cl.
*G21K 3/00* (2006.01)

(52) U.S. Cl. ..... 378/159; 378/16

(58) Field of Classification Search ..... 378/156–159, 378/4–20, 145–146
See application file for complete search history.

(56) References Cited

U.S. PATENT DOCUMENTS

| | | | | |
|---|---|---|---|---|
| 4,288,695 | A * | 9/1981 | Walters et al. | 378/5 |
| 5,301,108 | A * | 4/1994 | Hsieh | 378/8 |
| RE36,099 | E * | 2/1999 | Gordon | 378/20 |
| 6,307,918 | B1 * | 10/2001 | Toth et al. | 378/158 |
| 6,836,535 | B2 * | 12/2004 | Toth et al. | 378/159 |
| 6,990,171 | B2 * | 1/2006 | Toth et al. | 378/16 |
| 2002/0037067 | A1 * | 3/2002 | Horiuchi | 378/4 |
| 2004/0202283 | A1 * | 10/2004 | Okumura et al. | 378/145 |
| 2005/0013411 | A1 * | 1/2005 | Yahata et al. | 378/156 |

* cited by examiner

*Primary Examiner*—Hoon Song
(74) *Attorney, Agent, or Firm*—Vista IP Law Group LLP

(57) ABSTRACT

An apparatus for modulating an intensity of a radiation beam includes a filter having a cross sectional shape such that a radiation beam filtered therethrough and passed through a patient will have an intensity that is substantially non-uniform. An apparatus for modulating an intensity of a radiation beam generated by a radiation source includes a filter, and a positioner secured to the filter, the positioner configured to move the filter relative to the radiation source.

47 Claims, 6 Drawing Sheets

DEVICES AND METHODS FOR PROVIDING SPATIALLY VARIABLE X-RAY BEAM INTENSITY

BACKGROUND OF THE INVENTION

1. Field of the Invention

This invention relates generally to systems and methods for performing a radiation procedure, and more specifically, to systems and methods for obtaining images using a radiation machine.

2. Background of the Invention

Computed tomography is an imaging technique that has been widely used in the medical field. In a procedure for computed tomography, an x-ray source and a detector apparatus are positioned on opposite sides of a portion of a patient under examination. The x-ray source generates and directs a x-ray beam towards the patient, while the detector apparatus measures the x-ray absorption at a plurality of transmission paths defined by the x-ray beam during the process. The detector apparatus produces a voltage proportional to the intensity of incident x-rays, and the voltage is read and digitized for subsequent processing in a computer. By taking thousands of readings from multiple angles around the patient, relatively massive amounts of data are thus accumulated. The accumulated data are then analyzed and processed for reconstruction of a matrix (visual or otherwise), which constitutes a depiction of a density function of the bodily section being examined. By considering one or more of such sections, a skilled diagnostician can often diagnose various bodily ailments such as tumors, blood clots, etc.

When using computed tomography to examine bodily structures of a patient, a filter is generally placed between the patient and the x-ray source for modulating an intensity of an x-ray beam impinging on the patient during a CT scanning. Such filter is designed to reduce a dose to the patient modestly (reduce skin exposure by 30-40%) while having no detrimental effect on image quality. The cross-sectional shape of the filter, which is thin in the middle and thicker at its edges, is so configured such that the filter attenuates the beam more where the patient is the thinnest. Such arrangement compensates for differences in thicknesses over the cross-section of the patient's body so that an intensity of the x-ray beam exiting the patient is approximately uniform. Because existing filters are specially configured to provide an uniform image quality for an entire image of the patient's body, existing filters do not preferentially increase a dose (and hence improve an image quality) to a target region within the patient's body. In some cases, it may be desirable to obtain an image having a non-uniform image quality (e.g., it may be desirable to obtain good quality image for only a target region).

Also, there is a need to further reduce an overall dose of radiation delivered to a patient during a CT scan. Recently, some researchers have suggested the use of local tomography to reduce radiation dosage delivered to a patient. In this approach, the fan angle of the beam is reduced so that only a part of the patient is exposed to radiation during a CT scan. Although such technique substantially reduces radiation exposure to the patient, it is susceptible to substantial artifacts if highly attenuating structures are outside the region of interest. There are special local tomography reconstruction algorithms that can be used for reconstruction of images. However, these algorithms do not provide accurate CT numbers (Hounsfield Units). For the foregoing reason, local tomography is not suited to the use of CT scans for treatment planning applications, which requires an accurate determination of a density function of the bodily structure being examined.

For the foregoing, it would be desirable to have a method and a system for filtering radiation beam such that a dose to a target region can be increased to improve an image quality of the target region. It would also be desirable to have a method and a system for filtering radiation beam such that an overall dose of radiation delivered to a patient can be minimized or at least reduced during a radiation procedure.

SUMMARY OF THE INVENTION

In accordance with some embodiments of the invention, an apparatus for modulating an intensity of a radiation beam includes a filter having a size and a cross sectional shape such that an intensity of radiation beam filtered therethrough and passed through a patient will be substantially non-uniform.

In accordance with other embodiments of the invention, a method of modulating an intensity of a radiation beam includes directing a radiation beam towards a patient, and filtering the radiation beam such that an intensity of the radiation beam exiting the patient is substantially non-uniform.

In accordance with other embodiments of the invention, a radiation method includes generating an image using a radiation source, the image having an image of a target area and an image of non-target area, wherein a signal-to-noise ratio of the image of the target area is substantially higher than a signal-to-noise ratio of the image of the non-target area.

In accordance with other embodiments of the invention, an apparatus for modulating an intensity of a radiation beam generated by a radiation source includes a filter, and a positioner secured to the filter, the positioner configured to move the filter relative to the radiation source.

In accordance with other embodiments of the invention, a radiation method comprises placing a filter at a first position relative to a radiation source to obtain a first set of image data, and placing a filter at a second position relative to the radiation source to obtain a second set of image data.

In accordance with other embodiments of the invention, a computer program product that includes a medium is provided. The medium has a set of instruction, an execution of which by a processor causes a process to be performed, the process comprising sending a signal to move a filter relative to a radiation source.

Other aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how advantages and objects of the present invention are obtained, a more particular description of the present invention briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
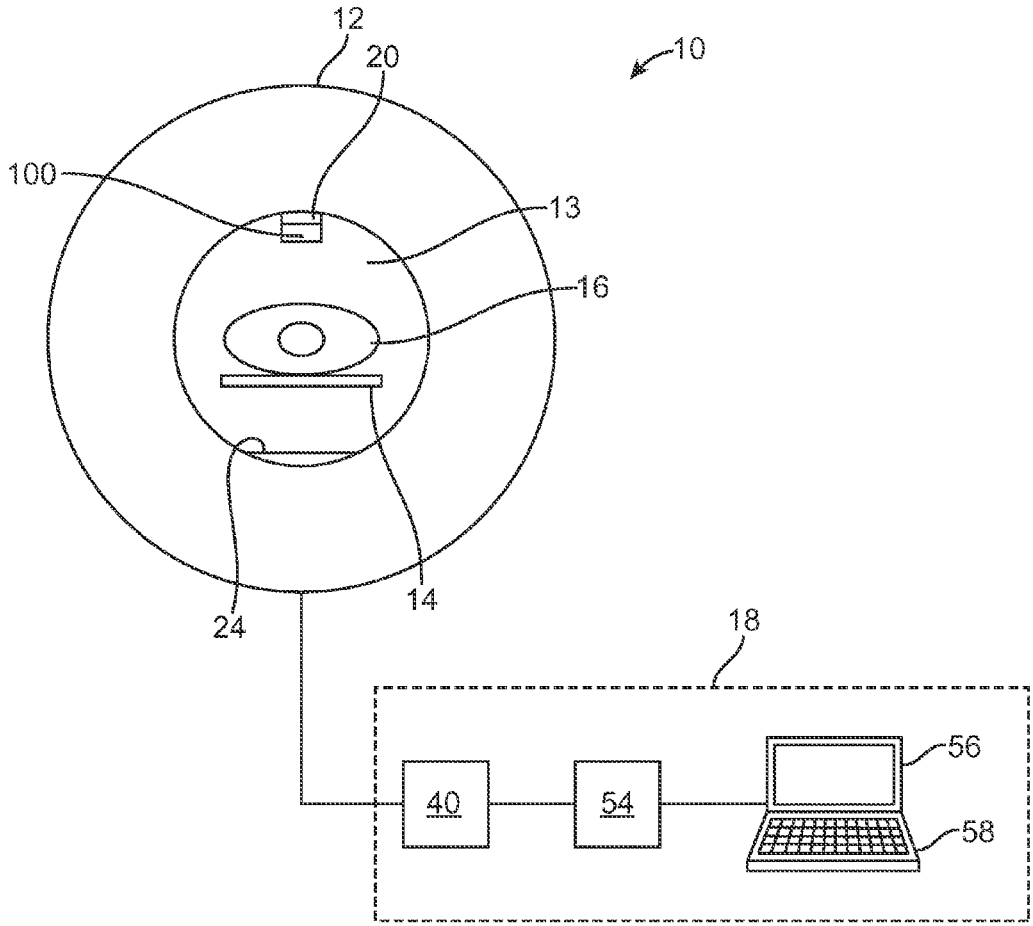
FIG. 1 illustrates a computed tomography system having a filter in accordance with some embodiments of the invention.

Various embodiments of the present invention are described hereinafter with reference to the figures. It should be noted that the figures are not drawn to scale and elements of similar structures or functions are represented by like reference numerals throughout the figures. It should also be noted that the figures are only intended to facilitate the description of specific embodiments of the invention. They are not intended as an exhaustive description of the invention or as a limitation on the scope of the invention. In addition, an aspect described in conjunction with a particular embodiment of the present invention is not necessarily limited to that embodiment and can be practiced in any other embodiments of the present invention.

Referring now to the drawings, in which similar or corresponding parts are identified with the same reference numeral, FIG. 1 illustrates a computed tomography image acquisition system 10, in which embodiments of the present invention can be employed. The system 10 includes a gantry 12 having an opening (or bore) 13, a patient support 14 for supporting a patient 16, and a control system 18 for controlling an operation of the gantry 12. The system 10 also includes a radiation source 20 (e.g., an x-ray source) that projects a beam of radiation (e.g., x-rays) towards a detector 24 on an opposite side of the gantry 12 while the patient 16 is positioned at least partially between the radiation source 20 and the detector 24. The detector 24 has a plurality of sensor elements configured for sensing a radiation that passes through the patient 16. Each sensor element generates an electrical signal representative of an intensity of the radiation beam as it passes through the patient 16.

In the illustrated embodiment, the control system 18 includes a processor 54, such as a computer processor, coupled to a gantry rotation control 40. The control system 18 may also include a monitor 56 for displaying data and an input device 58, such as a keyboard or a mouse, for inputting data. During a scan to acquire x-ray projection data (i.e., CT image data), the gantry 12 rotates about the patient 16. The rotation of the gantry 12 and the operation of the x-ray source 20 are controlled by the gantry rotation control 40, which provides power and timing signals to the x-ray source 20 and controls a rotational speed and position of the gantry 12 based on signals received from the processor 54. Although the control 40 is shown as a separate component from the gantry 12 and the processor 54, in alternative embodiments, the control 40 can be a part of the gantry 12 or the processor 54.

Figure 2:
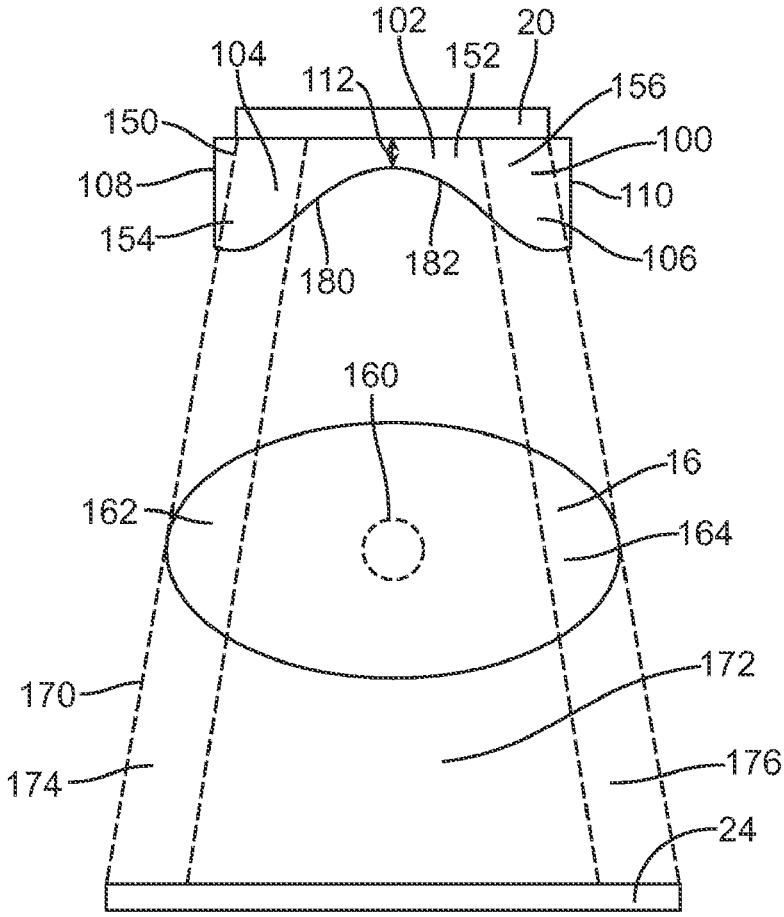
FIG. 2 illustrates the filter of FIG. 1 being used to attenuate a radiation beam in accordance with some embodiments of the invention.

The system 10 also includes a filter 100 configured to modulate an intensity of a radiation beam. As shown in FIG. 2, the filter 100 includes a center portion 102, a first end portion 104, and a second end portion 106. The first and the second end portions 104, 106 have respective sides 108, 110 that are thicker than a thickness 112 of the center portion 102. In the illustrated embodiments, the sides 108, 110 each has a thickness that is between 10 to 20 centimeters (cm). Alternatively, the sides 108, 110 can have other thicknesses, as long as an average thickness of each of the first and the second end portions 104, 106 is larger than the thickness 112 of the center portion 102. Such configuration allows the first and the second end portions 104, 106 to attenuate more radiation than the center portion 102. The filter 100 is made from a low atomic number material, such as a polymer, a plastic, aluminum, titanium, etc., that is at least partially transparent to a radiation beam such that radiation can be delivered to the patient 16. Alternatively, the filter 100 can be made from other materials.

As shown in FIG. 2, the cross-sectional shape of the filter 100 is so configured such that the filter 100 provides less attenuation effect on a portion 152 of a radiation beam 150 that is directed towards a target region 160, and more attenuation effect on portions 154, 156 of the radiation beam 150 that are not directed towards the target region 160 (e.g., that are directed towards adjacent regions 162, 164). This in turn results in an attenuated radiation beam 170 exiting the patient 16 having a substantially non-uniform intensity. In the illustrated example, a portion 172 of the attenuated radiation beam 170 exiting from the target region 160 of the patient 16 has a higher intensity than the rest (e.g., portions 174, 176) of the attenuated radiation beam 170, thereby creating an image of the target region 160 that has relatively higher signal-to-noise (SNR) than that of images of the adjacent regions 162, 164.

Attenuating portions of the radiation beam 150 going through non-target region more than the portion 152 of the radiation beam 150 going though the target region 160 is advantageous because it reduces radiation dose to non-target regions (e.g., regions 162, 164) where image quality is less critical, thereby reducing an overall dose of radiation to the patient 16. Since CT dose is characterized by a quantity (CT dose index) that averages dose over all regions of the patient 16, the CT dose index will decrease if part of the patient 16 is exposed to less radiation. Although, the above described technique will result in poorer CT image quality in the regions of the patient 16 outside of the volume of interest, in many cases, the image quality for non-target regions is less critical than that for the region of clinical interest, and the benefit of having a reduced overall dose of radiation delivered to the patient 16 outweighs the disadvantage of having poorer image quality for non-target regions.

In some embodiments, the filter 100 also allows the quality of the CT image at the target region 160 be enhanced for applications, such as radiation treatment planning and tumor targeting, where the clinical interest is focused on only a small anatomic volume. Particularly, through the use of the filter 100, more radiation dose can be delivered to the target region 160 to enhance a quality of an image of the target region 160 without exceeding a prescribed overall dose of radiation. This can be accomplished because radiation dose delivered to adjacent regions 162, 164 is reduced by the filter 100, thereby allowing more radiation dose be delivered to the target region 160. In some embodiments, a prescribed CT dose index can be maintained while using the filter 100, thereby allowing more radiation dose be delivered to the target region 160 to improve the CT image quality for the target region 160. Various techniques can be used to increase a radiation dose delivered to the target region 160. For example, the radiation source 20 can be configured to deliver a radiation beam having less energy in order to increase a radiation dose. As a result, the contrast and the signal-to-noise ratio in resulting images will increase, thereby making low contrast structures move visible. Such technique is particularly useful to obtain accurate delineation of anatomic structures, such as the prostate, which has low subject contrast.

Figure 3:
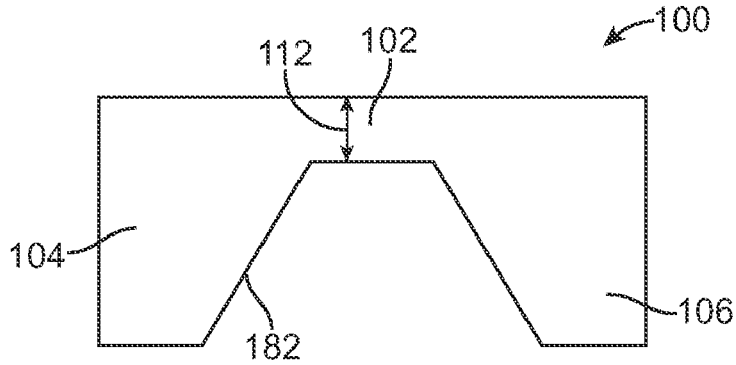
FIGS. 3-6 illustrate cross-sections of filters in accordance with other embodiments of the invention.
Figure 4:
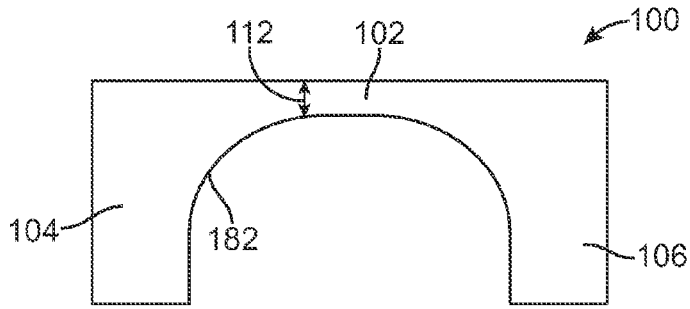
Figure 5:
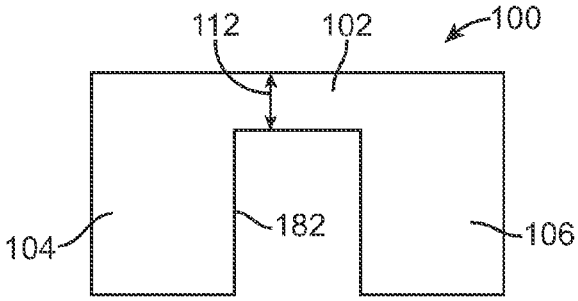
Figure 6:
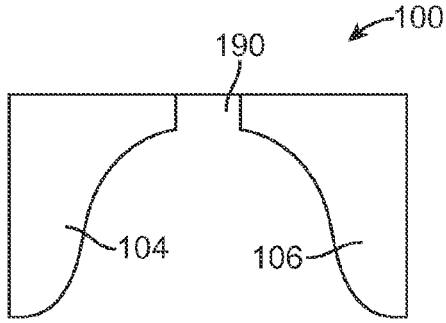

As shown in FIG. 2, the first and the second end portions 104, 106, together with the center portion 102, form a curvilinear continuous surface 180 having a cross-sectional profile 182 that smoothly changes with position (e.g., having a parabola profile). In alternative embodiments, the surface 180 of the filter 100 can have other cross-sectional profiles 182, such as, a profile that resembles a "V" shape (FIG. 3), a profile that resembles a "U" shape (FIG. 4), or a stepped profile (FIG. 5). Also, in other embodiments, the filter 100 can have an opening 190 such that at least a portion of the radiation beam 152 that is directed towards the target region 160 is not attenuated before it reaches the patient 16 (FIG. 6).

Figure 7:
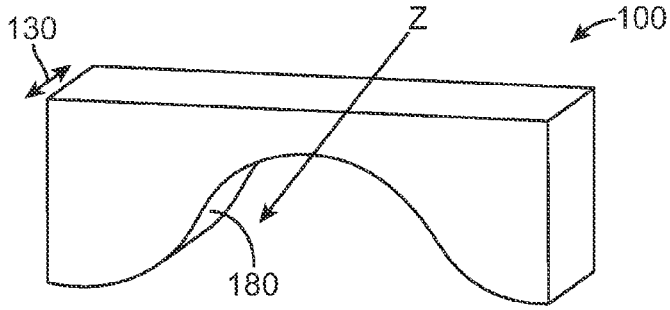
FIG. 7 illustrates a perspective view of the filter of FIG. 2 in accordance with some embodiments of the invention.
Figure 8:
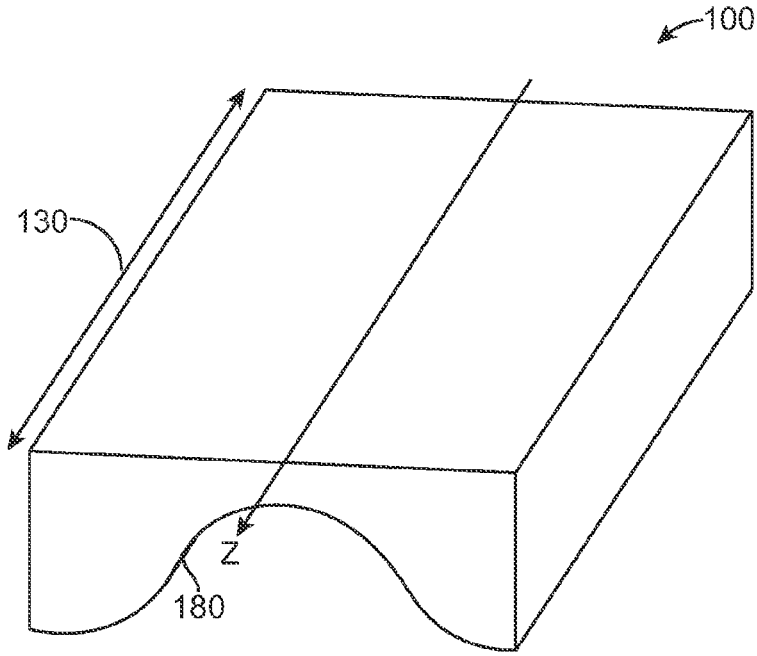
FIG. 8 illustrates a perspective view of the filter of FIG. 2 in accordance with other embodiments of the invention.

In any of the embodiments described herein the filter 100 can be used with a radiation source that delivers a fan beam, in which case, the filter 100 has length in a z-direction that is relatively short (FIG. 7). Alternatively, the filter 100 can be used with a radiation source that delivers a cone beam, in which case, the filter 100 has a length in the z-direction that is relatively long (FIG. 8). In other embodiments, the filter 100 can have a size and a shape that correspond to a radiation source with which the filter 100 is used.

Figure 9A:
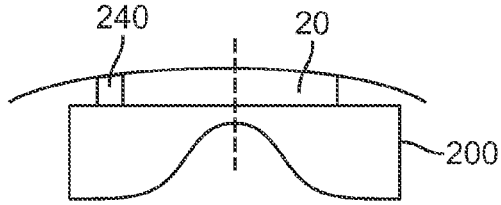
FIG. 9A-9C illustrate a device for modulating a radiation beam intensity in accordance with some embodiments of the invention.
Figure 9B:
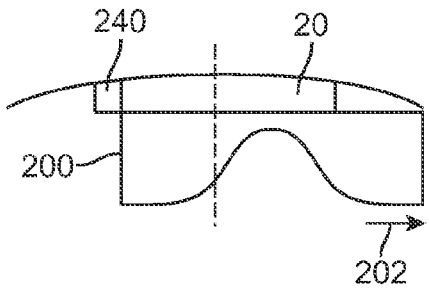
Figure 9C:
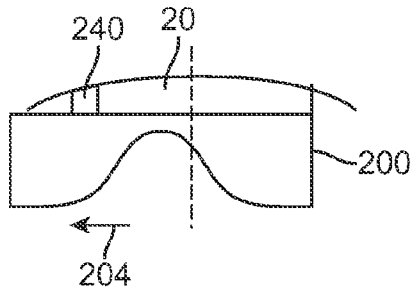

FIG. 9A illustrates a filter 200 in accordance with other embodiments of the invention. The filter 200 is similar to the filter 100 except that the filter 200 is moveable relative to the radiation source 20. Particularly, the filter 200 is coupled to a positioner 240, which is configured to translate the filter 200 back and forth in a first and a second directions 202, 204 (FIGS. 9B and 9C). In some embodiments, the positioner 240 can include a motor, such as an electric motor or a piezoelectric motor. Additionally, or alternatively, the positioner 240 can include hydraulic(s), scissor-type linkage(s), gear(s), chain(s), or other mechanical components, for causing the filter 200 to translate relative to the radiation source 20. It should be noted that the manner in which the positioner 240 is implemented is unimportant, and that the positioner 240 can be built using any components and techniques known in the art as long as it can perform the functions described herein. Although the positioner 240 is shown to be coupled to the radiation source 20, in other embodiments, the positioner 240 can be secured to the gantry 12. The filter 200 needs not have the configuration shown. In other embodiments, the filter 200 can have other configurations, such as any of those described with reference to FIGS. 3-6.

Figure 10:
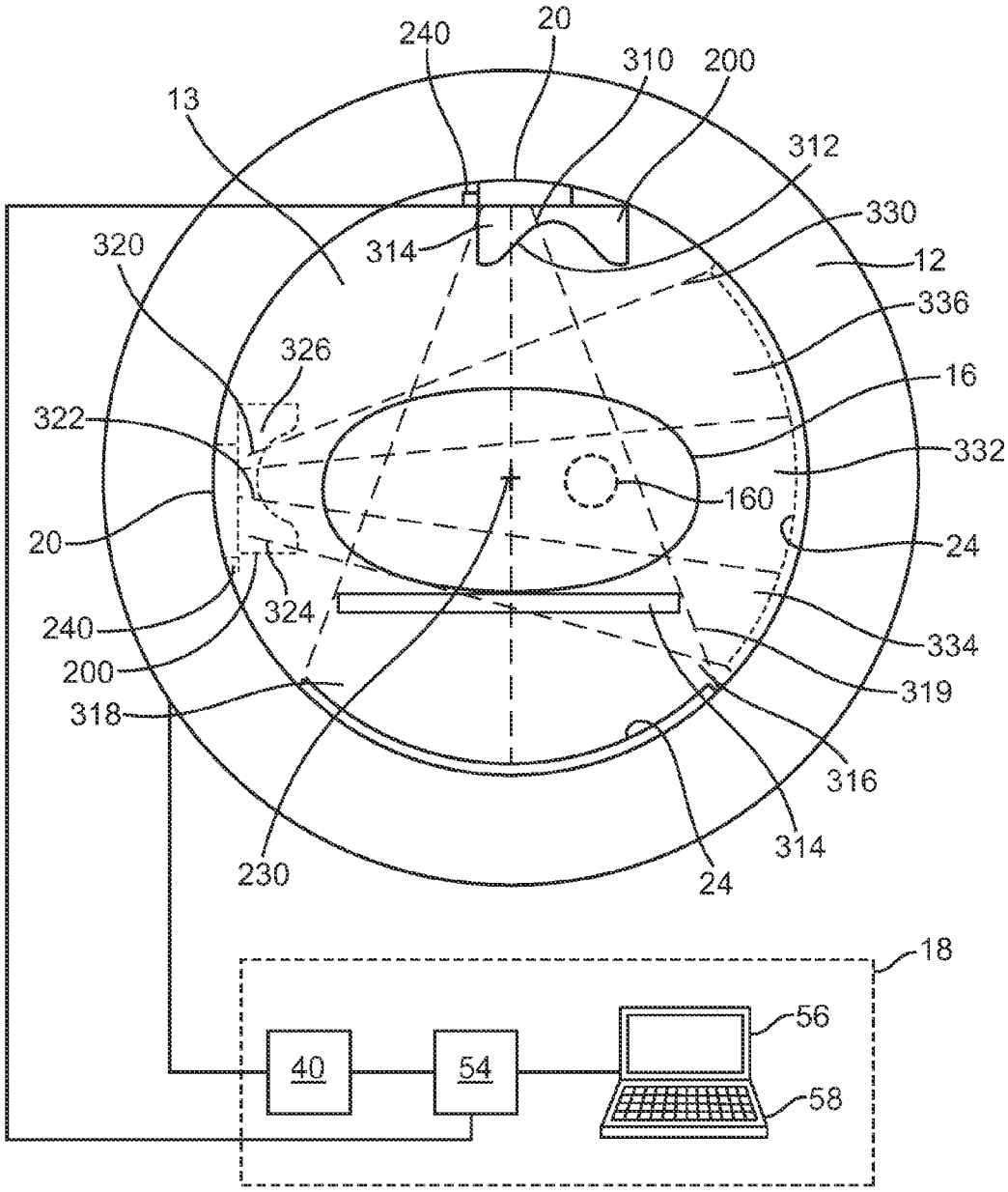
FIG. 10 is a diagram of a gantry, illustrating a method of using the device of FIG. 9A in accordance with some embodiments of the invention.

FIG. 10 illustrates a computed tomography image acquisition system 300 in accordance with some embodiments of the invention. The tomography image acquisition system 300 is similar to the system 10 of FIG. 1, except that it includes the filter 200 of FIG. 9 that is moveable relative to the radiation source 20. As shown in FIG. 10, the positioner 240 is connected to the processor 54, which controls an operation of the positioner 240 during use. Alternatively, the positioner 240 can be connected to the gantry rotation control 40. The system 300 can be used to acquire image data of a target region 160, which is located away from a center 230 of rotation of the gantry 12. During use, the gantry rotation control 40 controls a rotation of the gantry 12 and an operation of the x-ray source 20 based on signals received from the processor 54. The processor 54 also provides timing signals to cause the positioner 240 to move the filter 200 relative to the radiation source 20 in synchronization with the rotation of the gantry 12. It should be noted that the filter 200 of the system 300 needs not have the configuration shown, and that in other embodiments, the filter 200 of the system 300 can have other configurations, such as any of those described with reference to FIGS. 3-6.

As shown in FIG. 10, when the radiation source 20 is at a first gantry rotational position (shown in solid lines), the filter 200 is moved to a first position by the positioner 140 such that the thinner portion of the filter 200 is placed between a portion of a radiation beam that is directed towards the target region 160. Particularly, when the radiation source 20 is at the first gantry rotational position, the filter 200 is moved to a right position because the target region 160 is offset towards the right of the center 230 of rotation. At the right position, the filter 200 provides less attenuation effect on a portion 312 of a radiation beam 310 that is directed towards the target region 160, and more attenuation effect on a portion 314 of the radiation beam 310 that is not directed towards the target region 160. This in turn results in an attenuated radiation beam 319 exiting the patient 16 having a substantially non-uniform intensity. In the illustrated example, a portion 316 of the attenuated radiation beam 319 exiting from the target region 160 of the patient 16 has a higher intensity than the rest (e.g., portion 318) of the attenuated radiation beam 319, thereby creating an image of the target region 160 that is relatively sharper than images of the adjacent tissue regions.

After a first set of image data has been obtained at the first gantry rotational position, the radiation source 20 is then rotated to a second gantry rotational position. When the gantry 12 has moved the radiation source 20 to the second gantry rotational position (shown in dashed lines), the filter 200 is moved to a second position by the positioner 140 such that the thinner portion of the filter 200 is placed between a portion of a radiation beam that is directed towards the target region 160. Particularly, when the radiation source 20 is at the second gantry rotational position, the filter 200 is moved to a center position because the target region 160 is aligned with the center 230 of rotation. At the center position, the filter 200 provides less attenuation effect on a portion 322 of a radiation beam 320 that is directed towards the target region 160, and more attenuation effect on a portions 324, 326 of the radiation beam 320 that is not directed towards the target region 160. This in turn results in an attenuated radiation beam 330 exiting the patient 16 having a substantially non-uniform intensity. In the illustrated example, a portion 332 of the attenuated radiation beam 330 exiting from the target region 160 of the patient 16 has a higher intensity than the rest (e.g., portions 332, 334) of the attenuated radiation beam 330, thereby creating an image of the target region 160 that has a relatively higher SNR than that of images of the adjacent tissue regions.

Although, only two gantry rotational positions are shown, it should be understood that during an image acquisition session, the radiation source 20 can be placed at more than two gantry rotational positions to collect more than two sets of image data. For examples, the radiation source 20 can be rotated to positions that are between the two gantry rotational positions shown. The filter 200 can be, accordingly, positioned relative to the radiation source 20 in synchronization with the gantry rotational positions. In some cases, the filter 200 can be positioned relative to the radiation source 20 in a sinusoidal manner (i.e., the relative position between the filter 200 and the radiation source 20 varies in a sinusoidal manner). The range of positions at which the radiation source 20 can be placed varies. In some embodiments, the gantry 12 makes a 360° rotation around the patient 16 during an image data acquisition. Alternatively, if a full fan detector is used, the system 300 may acquire data while the gantry 12 rotates 180° plus the fan angle. Other angles of rotation may also be used, depending on the particular system being employed.

It should be noted that instead of using the filter 100 or 200 for fan beam CT or cone beam CT, any of the embodiments of the filter can be used with other imaging techniques, such as Spiral CT, laminar tomography, or the like, to reduce radiation dose to a patient and/or to enhance an image quality of a target region. As such, the configuration of the filter should not be limited to those described herein, and the filter can be variously sized and shaped to suit the need of a particular imaging technique.

Computer System Architecture

Figure 11:
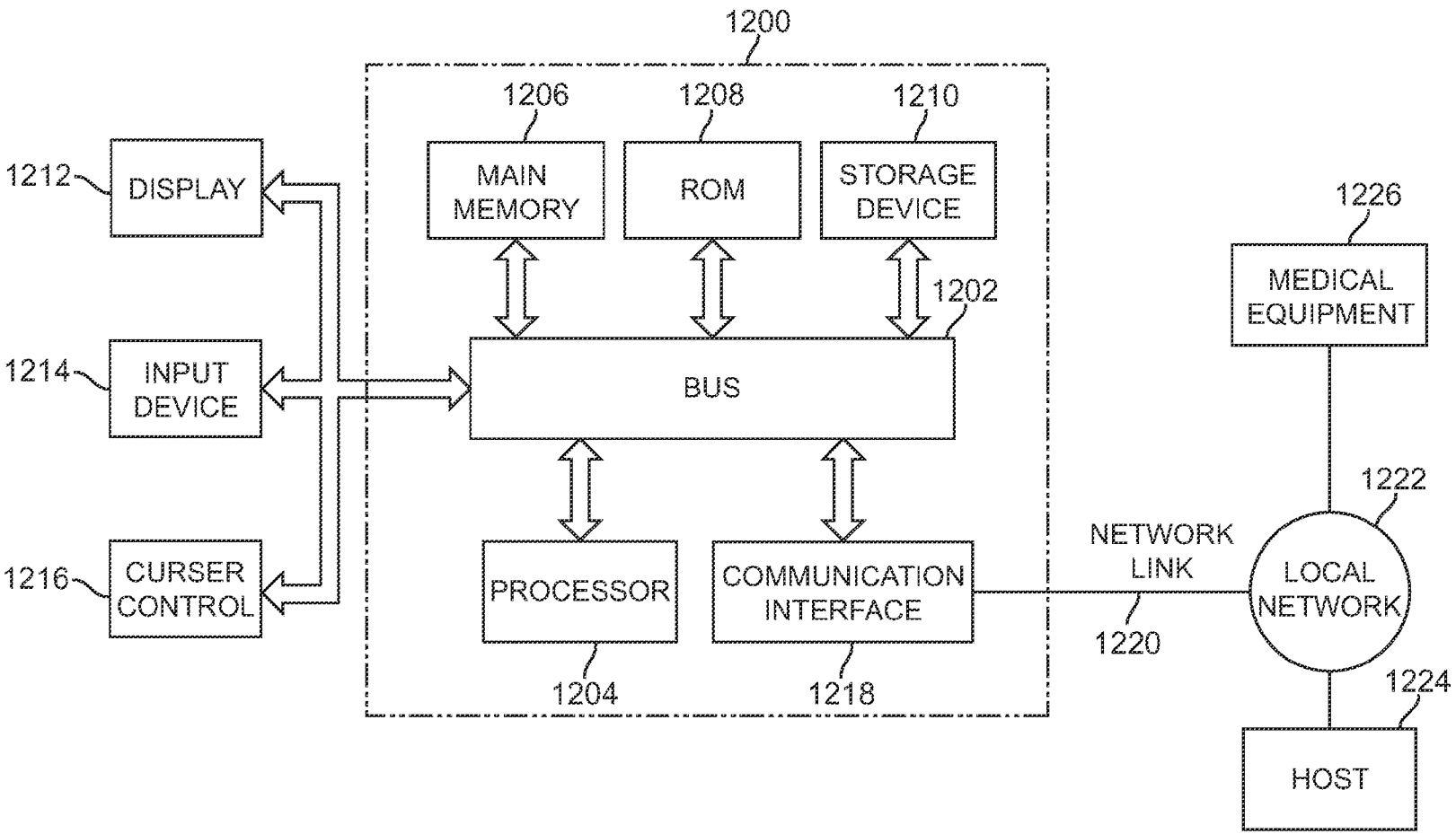
FIG. 11 is a block diagram that illustrates an embodiment of a computer system upon which embodiments of the invention may be implemented.

FIG. 11 is a block diagram that illustrates an embodiment of a computer system 1200 upon which an embodiment of the invention may be implemented. Computer system 1200 includes a bus 1202 or other communication mechanism for communicating information, and a processor 1204 coupled with the bus 1202 for processing information. The processor 1204 may be an example, or a component, of the processor 54 of FIG. 1. In some cases, the computer system 1200 may be used to implement the processor 54. The computer system 1200 also includes a main memory 1206, such as a random access memory (RAM) or other dynamic storage device, coupled to the bus 1202 for storing information and instructions to be executed by the processor 1204. The main memory 1206 also may be used for storing temporary variables or other intermediate information during execution of instructions to be executed by the processor 1204. The computer system 1200 further includes a read only memory (ROM) 1208 or other static storage device coupled to the bus 1202 for storing static information and instructions for the processor 1204. A data storage device 1210, such as a magnetic disk or optical disk, is provided and coupled to the bus 1202 for storing information and instructions.

The computer system 1200 may be coupled via the bus 1202 to a display 1212, such as a cathode ray tube (CRT), for displaying information to a user. An input device 1214, including alphanumeric and other keys, is coupled to the bus 1202 for communicating information and command selections to processor 1204. Another type of user input device is cursor control 1216, such as a mouse, a trackball, or cursor direction keys for communicating direction information and command selections to processor 1204 and for controlling cursor movement on display 1212. This input device typically has two degrees of freedom in two axes, a first axis (e.g., x) and a second axis (e.g., y), that allows the device to specify positions in a plane.

One aspect of the invention is related to the use of computer system 1200 for sending timing signals to control a movement of a filter (e.g., filter 200). According to one embodiment of the invention, such use is provided by computer system 1200 in response to processor 1204 executing one or more sequences of one or more instructions contained in the main memory 1206. Such instructions may be read into the main memory 1206 from another computer-readable medium, such as storage device 1210. Execution of the sequences of instructions contained in the main memory 1206 causes the processor 1204 to perform the process steps described herein. One or more processors in a multi-processing arrangement may also be employed to execute the sequences of instructions contained in the main memory 1206. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to the processor 1204 for execution. Such a medium may take many forms, including but not limited to, non-volatile media, volatile media, and transmission media. Non-volatile media includes, for example, optical or magnetic disks, such as the storage device 1210. Volatile media includes dynamic memory, such as the main memory 1206. Transmission media includes coaxial cables, copper wire and fiber optics, including the wires that comprise the bus 1202. Transmission media can also take the form of acoustic or light waves, such as those generated during radio wave and infrared data communications.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer-readable media may be involved in carrying one or more sequences of one or more instructions to the processor 1204 for execution. For example, the instructions may initially be carried on a magnetic disk of a remote computer. The remote computer can load the instructions into its dynamic memory and send the instructions over a telephone line using a modem. A modem local to the computer system 1200 can receive the data on the telephone line and use an infrared transmitter to convert the data to an infrared signal. An infrared detector coupled to the bus 1202 can receive the data carried in the infrared signal and place the data on the bus 1202. The bus 1202 carries the data to the main memory 1206, from which the processor 1204 retrieves and executes the instructions. The instructions received by the main memory 1206 may optionally be stored on the storage device 1210 either before or after execution by the processor 1204.

The computer system 1200 also includes a communication interface 1218 coupled to the bus 1202. The communication interface 1218 provides a two-way data communication coupling to a network link 1220 that is connected to a local network 1222. For example, the communication interface 1218 may be an integrated services digital network (ISDN) card or a modem to provide a data communication connection to a corresponding type of telephone line. As another example, the communication interface 1218 may be a local area network (LAN) card to provide a data communication connection to a compatible LAN. Wireless links may also be implemented. In any such implementation, the communication interface 1218 sends and receives electrical, electromagnetic or optical signals that carry data streams representing various types of information.

The network link 1220 typically provides data communication through one or more networks to other devices. For example, the network link 1220 may provide a connection through local network 1222 to a host computer 1224 or to medical equipment 1226 such as a radiation beam source or a switch operatively coupled to a radiation beam source. The data streams transported over the network link 1220 can comprise electrical, electromagnetic or optical signals. The signals through the various networks and the signals on the network link 1220 and through the communication interface 1218, which carry data to and from the computer system 1200, are exemplary forms of carrier waves transporting the information. The computer system 1200 can send messages and receive data, including program code, through the network(s), the network link 1220, and the communication interface 1218.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. For example, the operations performed by the processor 54 can be performed by any combination of hardware and software within the scope of the invention, and should not be limited to particular embodiments comprising a particular definition of "processor". In addition, the term "image" as used in this specification includes image data that may be stored in a circuitry or a computer-readable medium, and should not be limited to image data that is displayed visually. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. A radiation method, comprising:

moving a filter to a first position relative to a radiation source to obtain a first set of image data, the filter having an axis, a first cross sectional shape at a first point along the axis, and a second cross sectional shape at a second point along the axis, the first cross sectional shape being the same as the second cross sectional shape, wherein the filter has end portions that are thicker than a mid portion, the end portions being fixed in position relative to each other, and wherein the filter is made from a material that is partially transparent to radiation; and moving the filter to a second position relative to the radiation source to obtain a second set of image data;

wherein the filter is moved to the first position relative to the radiation source based on a first gantry position of the radiation source; and wherein the radiation source is capable of movement within a plane, and the filter is moved by a positioner to the first position in a direction that is parallel to the plane.

2. The method of claim 1, further comprising rotating the radiation source from the first gantry position to a second gantry position.

3. The method of claim 2, wherein the filter is at the first position when the radiation source is at the first gantry position, and the filter is at the second position when the radiation source is at the second gantry position.

4. The method of claim 2, wherein the acts of moving are performed in synchronization with a rotation of the radiation source.

5. The method of claim 1, wherein the filter is moved relative to the radiation source in a back-and-forth manner.

6. The method of claim 1, wherein the filter is moved to the second position in response to a change in the first gantry position.

7. The radiation method of claim 1, wherein the radiation source is configured to move along a circular path or partial circular path that lies within the plane.

8. An apparatus for modulating an intensity of a radiation beam generated by a radiation source, comprising:

a filter made from a material that is partially transparent to radiation, the filter having end portions that are thicker than a middle portion, wherein the end portions are fixed in position relative to each other; and a positioner secured to the filter, the positioner configured to move the filter relative to the radiation source based on a gantry position of the radiation source;

wherein the radiation source is capable of movement within a plane, and the positioner is configured to move the filter in a direction that is parallel to the plane.

9. The apparatus of claim 8, wherein the filter has a configuration such that the radiation beam filtered therethrough and passed through an object can be used to create an image having a first region and a second region, the first region having a poorer image quality relative to that of the second region.

10. The apparatus of claim 1, wherein the first region of the image corresponds to one of the end portions of the filter, and the second region of the image corresponds to the middle portion of the filter.

11. The apparatus of claim 1, wherein the second region contains an image of a target region.

12. The apparatus of claim 8, wherein the filter does not include a moveable leaf.

13. The apparatus of claim 8, wherein the filter has an axis, a first cross sectional shape at a first point along the axis, and a second cross sectional shape at a second point along the axis, the first cross sectional shape being the same as the second cross sectional shape.

14. The apparatus of claim 13, wherein the axis of the filter is parallel to an axis of a bore of a radiation machine.

15. The apparatus of claim 13, wherein the axis of the filter is parallel to a longitudinal axis of a patient support.

16. The apparatus of claim 8, wherein a first radiation transmitted through the middle portion of the filter and through a middle portion of an object has an intensity that is higher than an intensity of a second radiation transmitted through one of the end portions of the filter and through a side portion of the object.

17. The apparatus of claim 8, wherein the end portions and the middle portion form a U-shape.

18. The apparatus of claim 8, wherein the filter is configured to filter radiation directed towards an object, the filter having an attenuation profile that does not complement an attenuation pattern of the object.

19. The apparatus of claim 8, wherein the filter is configured to filter radiation directed towards an object such that radiation exciting the object has an intensity that is non-uniform.

20. The apparatus of claim 8, wherein the positioner is configured to move the filter relative to the radiation source based also on a position of an object to which the radiation beam is being directed.

21. The apparatus of claim 8, wherein the positioner is configured to move the filter relative to the radiation source in a back-and-forth manner.

22. The apparatus of claim 8, wherein the positioner is configured to move the filter relative to the radiation source in synchronization with a rotation of the radiation source.

23. The apparatus of claim 8, further comprising the radiation source, wherein the radiation source is located next to a gantry opening, the opening having an axis.

24. The apparatus of claim 23, wherein at least a portion of the filter has a cross sectional shape that is uniform along a direction of the axis.

25. The apparatus of claim 23, wherein the positioner is configured to move the filter relative to the radiation source in a direction that forms an angle with the axis.

26. The apparatus of claim 8, wherein the radiation source is configured to move along a circular path or partial circular path that lies within the plane.

27. A radiation method, comprising:

moving a filter to a first position relative to a radiation source to obtain a first set of image data, wherein the filter is made from a material that is partially transparent to radiation, the filter having end portions that are thicker than a middle portion, wherein the end portions are fixed in position relative to each other; and moving the filter to a second position relative to the radiation source to obtain a second set of image data;

wherein the filter is moved to the first position relative to the radiation source based on a first gantry position of the radiation source, and the filter is moved to the second position relative to the radiation source based on a second gantry position of the radiation source; and wherein the radiation source is capable of movement within a plane, and the filter is moved by a positioner to the first position in a direction that is parallel to the plane.

28. The method of claim 27, wherein the filter is configured to filter radiation directed towards an object, the filter having an attenuation profile that does not complement an attenuation pattern of the object.

29. The method of claim 27, wherein the filter is configured to filter radiation directed towards an object such that radiation exciting the object has an intensity that is non-uniform.

30. The method of claim 27, wherein the acts of moving the filter comprise moving the filter relative to the radiation source in a back-and-forth manner.

31. The method of claim 27, wherein the acts of moving the filter are performed in synchronization with a rotation of the radiation source.

32. The radiation method of claim 27, wherein the radiation source is configured to move along a circular path or partial circular path that lies within the plane.

33. An apparatus for modulating an intensity of a radiation beam generated by a radiation source that is configured to move within a plane, comprising:

a filter made from a material that is partially transparent to radiation; and a positioner secured to the filter, the positioner configured to move the filter relative to the radiation source in a direction based on a gantry position of the radiation source, wherein the direction is parallel to the plane;

wherein the filter has end portions that are thicker than a middle portion, the end portions being incapable of movement relative to each other.

34. The apparatus of claim 33, wherein the filter has a center portion, a first end portion, and a second end portion, the first and the second end portions having respective thicknesses that are larger than a thickness of the center portion.

35. The apparatus of claim 34, wherein the thickness of each of the first and the second end portions is selected such that an intensity of the radiation beam exiting a patient is approximately uniform.

36. The apparatus of claim 34, wherein the thickness of each of the first and the second end portions is selected such that an intensity of the radiation beam exiting a patient is substantially non-uniform.

37. The apparatus of claim 33, further comprising a processor for controlling an operation of the positioner.

38. The apparatus of claim 37, wherein the processor is configured to cause the filter to move relative to the radiation source in a back-and-forth manner.

39. The apparatus of claim 37, wherein the processor is configured to cause the filter to move relative to the radiation source in synchronization with a rotation of a gantry to which the radiation source is mounted.

40. The apparatus of claim 33, further comprising a processor programmed to transmit a signal for instructing the positioner to move the filter based on a relative position between the radiation source and an object that is being imaged.

41. The apparatus of claim 33, wherein the filter has an attenuation profile that does not complement an attenuation pattern of an object that is being imaged.

42. The apparatus of claim 33, wherein the radiation source is configured to move in a circular path or partial circular path that lies within the plane.

43. A computer program product that includes a medium, the medium having a set of instruction, an execution of which by a processor causes a process to be performed, the process comprising:

sending a signal to move a filter in a direction relative to a radiation source based on a gantry position of the radiation source, the radiation source configured to move within a plane, wherein the direction is parallel to the plane;

wherein the filter has end portions that are thicker than a middle portion, the end portions being incapable of movement relative to each other.

44. The computer program of claim 43, wherein the signal is for causing the filter to move relative to the radiation source in synchronization with the gantry position of the radiation source.

45. The computer program product of claim 43, wherein the process further comprises sending another signal to move the filter in another direction that is opposite to the direction.

46. The computer program product of claim 43, wherein the radiation source is configured to move along a circular path or partial circular path that lies within the plane.

47. The method of claim 1, wherein the first set of image data comprises an image having a first region and a second region, the first region having a poorer image quality relative to that of the second region.

* * * * *

UNITED STATES PATENT AND TRADEMARK OFFICE

CERTIFICATE OF CORRECTION

PATENT NO. : 7,474,736 B2
APPLICATION NO. : 10/957064
DATED : January 6, 2009
INVENTOR(S) : Peter N. Munro and Kenneth W. Brooks It is certified that error appears in the above-identified patent and that said Letters Patent is hereby corrected as shown below:

Column 10, Line 13, in claim 10, replace “claim 1” with “claim 9”.

Column 10, Line 17, in claim 11, replace “claim 1” with “claim 9”.

Signed and Sealed this

Twenty-first Day of April, 2009

John Doll

JOHN DOLL
*Acting Director of the United States Patent and Trademark Office*